US011286548B2

(12) United States Patent
Kamo et al.

(10) Patent No.: US 11,286,548 B2
(45) Date of Patent: *Mar. 29, 2022

(54) HIGH-STRENGTH STAINLESS STEEL SEAMLESS PIPE FOR OIL COUNTRY TUBULAR GOODS, AND METHOD FOR MANUFACTURING SAME

(71) Applicant: JFE Steel Corporation, Tokyo (JP)

(72) Inventors: Yuichi Kamo, Tokyo (JP); Masao Yuga, Tokyo (JP); Kenichiro Eguchi, Tokyo (JP); Yasuhide Ishiguro, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/638,561

(22) PCT Filed: Jul. 25, 2018

(86) PCT No.: PCT/JP2018/027997
§ 371 (c)(1),
(2) Date: Feb. 12, 2020

(87) PCT Pub. No.: WO2019/035329
PCT Pub. Date: Feb. 21, 2019

(65) Prior Publication Data

US 2020/0216936 A1 Jul. 9, 2020

(30) Foreign Application Priority Data

Aug. 15, 2017 (JP) ..... JP2017-156836

(51) Int. Cl.

| | |
|---|---|
| ***C22C 38/54*** | (2006.01) |
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/54* (2013.01); *C21D 8/10* (2013.01); *C21D 9/08* (2013.01); *C22C 38/001* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/001* (2013.01); *C21D 2211/005* (2013.01)

(58) Field of Classification Search
CPC ..... C22C 38/54; C22C 38/001; C22C 38/008; C22C 38/02; C22C 38/04; C22C 38/06; C22C 38/42; C22C 38/44; C22C 38/46; C22C 38/48; C22C 38/50; C21D 8/10; C21D 9/08; C21D 2211/001; C21D 2211/005
USPC ..... 420/61
See application file for complete search history.

(56) References Cited

U.S. PATENT DOCUMENTS

| | | | | |
|---|---|---|---|---|
| 5,778,714 | A * | 7/1998 | Katsumura | B21B 25/00 72/209 |
| 7,767,037 | B2 | 8/2010 | Kimura et al. | |
| 8,608,872 | B2 | 12/2013 | Kondo et al. | |
| 9,322,087 | B2 | 4/2016 | Takabe et al. | |
| 9,783,876 | B2 | 10/2017 | Nakatsuka et al. | |
| 10,995,394 | B2 | 5/2021 | Matsuo et al. | |
| 11,085,095 | B2 * | 8/2021 | Eguchi | C21D 8/105 |

(Continued)

FOREIGN PATENT DOCUMENTS

| | | |
|---|---|---|
| EP | 2933344 A1 | 10/2015 |
| JP | 2005336595 A | 12/2005 |

(Continued)

OTHER PUBLICATIONS

Boljanovic, Vukota. (2010). Metal Shaping Processes—Casting and Molding; Particulate Processing; Deformation Processes; and Metal Removal—6.4.1 Pierce and Pilger Rolling Process. (pp. 141-143). Industrial Press. (Year: 2010).*

(Continued)

*Primary Examiner* — Brian D Walck
*Assistant Examiner* — Danielle Carda
(74) *Attorney, Agent, or Firm* — RatnerPrestia

(57) ABSTRACT

The invention is intended to provide a high-strength stainless steel seamless pipe for oil country tubular goods having high strength with a yield strength of 862 MPa (125 ksi) or more, excellent low-temperature toughness, and excellent corrosion resistance. The invention is also intended to provide a method for manufacturing such a high-strength stainless steel seamless pipe. The high-strength stainless steel seamless pipe has a microstructure that is at least 45% tempered martensite phase, 20 to 40% ferrite phase, and more than 10% and 25% or less retained austenite phase by volume. The high-strength stainless steel seamless pipe has a yield strength of 862 MPa or more, and a maximum crystal grain diameter of 500 μm or less for ferrite crystal grains when crystal grains with a crystal orientation difference of within 15° are defined as the same crystal grains.

9 Claims, No Drawings

(56) References Cited

U.S. PATENT DOCUMENTS

| | | | | |
|---|---|---|---|---|
| 2015/0315684 | A1* | 11/2015 | Eguchi | C22C 38/54 148/506 |
| 2018/0023158 | A1 | 1/2018 | Sasaki et al. | |
| 2019/0100821 | A1 | 4/2019 | Eguchi et al. | |
| 2019/0241989 | A1 | 8/2019 | Endo et al. | |
| 2019/0376157 | A1 | 12/2019 | Kamo et al. | |
| 2020/0157646 | A1* | 5/2020 | Eguchi | C21D 6/008 |
| 2020/0216936 | A1 | 7/2020 | Kamo et al. | |
| 2020/0283866 | A1 | 9/2020 | Endo et al. | |

FOREIGN PATENT DOCUMENTS

| | | | |
|---|---|---|---|
| JP | 2008081793 | A | 4/2008 |
| JP | 2010209402 | A | 9/2010 |
| JP | 2012149317 | A | 8/2012 |
| JP | 2017039998 | A | 2/2017 |
| JP | 6156609 | B1 | 7/2017 |
| WO | 2010050519 | A1 | 5/2010 |
| WO | 2010134498 | A1 | 11/2010 |
| WO | 2013146046 | A1 | 10/2013 |
| WO | 2016132403 | A1 | 8/2016 |
| WO | 2017010036 | A1 | 1/2017 |
| WO | 2017200083 | A1 | 11/2017 |

OTHER PUBLICATIONS

International Search Report and Written Opinion for International Application No. PCT/JP2018/027997, dated Oct. 23, 2018, 5 pages.
Japanese Office Action for Japanese Application No. 2018-557950, dated Dec. 13, 2019, with Concise Statement of Relevance of Office Action, 4 pages.
Extended European Search Report for European Application No. 18846146.1, dated Jul. 14, 2020, 8 pages.

* cited by examiner

HIGH-STRENGTH STAINLESS STEEL SEAMLESS PIPE FOR OIL COUNTRY TUBULAR GOODS, AND METHOD FOR MANUFACTURING SAME

CROSS REFERENCE TO RELATED APPLICATIONS

This is the U.S. National Phase application of PCT/JP2018/027997, filed Jul. 25, 2018, which claims priority to Japanese Patent Application No. 2017-156836, filed Aug. 15, 2017, the disclosures of these applications being incorporated herein by reference in their entireties for all purposes.

FIELD OF THE INVENTION

The present invention relates to a 17Cr based high-strength stainless steel seamless pipe preferred for use in oil country tubular goods used in oil well and gas well applications (hereinafter, referred to simply as "oil country tubular goods"). Particularly, the present invention relates to improvement of corrosion resistance in corrosive environments, particularly in a severe, high-temperature corrosive environment containing carbon dioxide gas ($CO_2$) and chlorine ions ($Cl^-$), and in a hydrogen sulfide ($H_2S$)-containing environment. The invention also relates to improvement of low-temperature toughness.

BACKGROUND OF THE INVENTION

An expected shortage of energy resources in the near future has prompted active development of oil country tubular goods for use in severe corrosive environments that were unthinkable in the past, for example, such as in deep oil fields, an environment containing carbon dioxide gas, and a hydrogen sulfide-containing environment, or a sour environment as it is also called. Steel pipes for oil country tubular goods intended for these environments require high strength, and excellent corrosion resistance.

Oil country tubular goods used for mining of oil fields and gas fields of an environment containing $CO_2$ gas, $Cl^-$, and the like typically use 13Cr martensitic stainless steel pipes. There has also been development of oil country tubular goods intended for use in higher temperature environments (as high as 200° C.). However, the corrosion resistance of the 13Cr martensitic stainless steel is not always sufficient in such applications. This has created a demand for a steel pipe for oil country tubular goods that has excellent corrosion resistance sufficient for use in such environments.

Out of such demands, for example, PTL 1 describes a high-strength stainless steel pipe for oil country tubular goods having excellent corrosion resistance. The high-strength stainless steel pipe is of a composition containing, in mass %, C: 0.005 to 0.05%, Si: 0.05 to 0.5%, Mn: 0.2 to 1.8%, P: 0.03% or less, S: 0.005% or less, Cr: 15.5 to 18%, Ni: 1.5 to 5%, Mo: 1 to 3.5%, V: 0.02 to 0.2%, N: 0.01 to 0.15%, and O: 0.006% or less, in which Cr, Ni, Mo, Cu, and C satisfy a specific relation, and Cr, Mo, Si, C, Mn, Ni, Cu, and N satisfy a specific relation, and of a microstructure containing a martensite phase as a base phase, and that is 10 to 60% ferrite phase, and, optionally, 30% or less austenite phase by volume. In this way, PTL 1 allegedly enables stably providing a stainless steel pipe for oil country tubular goods that shows sufficient corrosion resistance even in a severe corrosive environment containing $CO_2$ and $Cl^-$ where the temperature reaches as high as 230° C., and that has high strength with a yield strength of more than 654 MPa (95 ksi), and high toughness.

PTL 2 describes a high-strength stainless steel pipe for oil country tubular goods having high toughness and excellent corrosion resistance. The high-strength stainless steel pipe is of a composition containing, in mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less, and O: 0.006% or less, in which Cr, Mo, W, and C satisfy a specific relationship, Cr, Mo, W, Si, C, Mn, Cu, Ni, and N satisfy a specific relationship, and Mo and W satisfy a specific relationship, and of a microstructure containing a martensite phase as a base phase, and 10 to 50% ferrite phase in terms of a volume fraction. In this way, PTL 2 allegedly enables stably providing a high-strength stainless steel pipe for oil country tubular goods that has high strength with a yield strength of more than 654 MPa (95 ksi), and that shows sufficient corrosion resistance even in a severe, high-temperature corrosive environment containing $CO_2$, $Cl^-$, and $H_2S$.

PTL 3 describes a high-strength stainless steel pipe having excellent sulfide stress cracking resistance and excellent high-temperature carbon dioxide corrosion resistance. The high-strength stainless steel pipe is of a composition containing, in mass %, C: 0.05% or less, Si: 1.0% or less, P: 0.05% or less, S: less than 0.002%, Cr: more than 16% and 18% or less, Mo: more than 2% and 3% or less, Cu: 1 to 3.5%, Ni: 3% or more and less than 5%, Al: 0.001 to 0.1%, and O: 0.01% or less, in which Mn and N satisfy a specific relationship in a region where Mn is 1% or less, and N is 0.05% or less, and of a microstructure containing a martensite phase as a dominant phase, 10 to 40% ferrite phase, and 10% or less retained austenite (γ) phase in terms of a volume fraction. In this way, PTL 3 allegedly enables providing a high-strength stainless steel pipe having high strength with a yield strength of 758 MPa (110 ksi) or more, and having excellent corrosion resistance so that sufficient corrosion resistance can be obtained even in a carbon dioxide gas environment of a temperature as high as 200° C., and sufficient sulfide stress cracking resistance can be obtained even when the ambient gas temperature is low.

PTL 4 describes a stainless steel pipe for oil country tubular goods having high strength with a 0.2% proof stress of 758 MPa or more. The stainless steel pipe has a composition containing, in mass %, C: 0.05% or less, Si: 0.5% or less, Mn: 0.01 to 0.5%, P: 0.04% or less, S: 0.01% or less, Cr: more than 16.0 to 18.0%, Ni: more than 4.0 to 5.6%, Mo: 1.6 to 4.0%, Cu: 1.5 to 3.0%, Al: 0.001 to 0.10%, and N: 0.050% or less, in which Cr, Cu, Ni, and Mo satisfy a specific relationship, and (C+N), Mn, Ni, Cu, and (Cr+Mo) satisfy a specific relationship. The stainless steel pipe has a microstructure containing a martensite phase, and 10 to 40% ferrite phase by volume, and in which the length from the surface is 50 μm in thickness direction, and the proportion of imaginary line segments that cross the ferrite phase is more than 85% in a plurality of imaginary line segments disposed side by side in a 10 μm-pitch within a range of 200 μm. In this way, PTL 4 allegedly enables providing a stainless steel pipe for oil country tubular goods having excellent corrosion resistance in a high-temperature environment of 150 to 250° C., and excellent sulfide stress corrosion cracking resistance at ordinary temperature.

PTL 5 describes a high-strength stainless steel pipe for oil country tubular goods having high toughness, and excellent corrosion resistance. The high-strength stainless steel pipe has a composition containing, in mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less, O: 0.006% or less, in which Cr, Mo, W, and C satisfy a specific relationship, and Cr, Mo, W, Si, C, Mn, Cu, Ni, and N satisfy a specific relationship, and Mo and W satisfy a specific relationship. The high-strength stainless steel pipe has a microstructure in which the distance between given two points within the largest crystal grain is 200 μm or less. In this way, PTL 5 allegedly enables providing a stainless steel pipe having high strength with a yield strength of more than 654 MPa (95 ksi), and that has excellent toughness, and shows sufficient corrosion resistance in a $CO_2$-, $Cl^-$-, and $H_2S$-containing high-temperature corrosive environment of 170° C. or more.

PTL 6 describes a high-strength martensitic stainless steel seamless pipe for oil country tubular goods having a composition containing, in mass %, C: 0.01% or less, Si: 0.5% or less, Mn: 0.1 to 2.0%, P: 0.03% or less, S: 0.005% or less, Cr: more than 15.5 and 17.5% or less, Ni: 2.5 to 5.5%, Mo: 1.8 to 3.5%, Cu: 0.3 to 3.5%, V: 0.20% or less, Al: 0.05% or less, and N: 0.06% or less. The high-strength martensitic stainless steel seamless pipe has a microstructure that contains preferably at least 15% ferrite phase, and, optionally, 25% or less retained austenite phase by volume, and the balance is a tempered martensite phase. It is stated in PTL 6 that the composition may additionally contain W: 0.25 to 2.0%, and/or Nb: 0.20% or less. In this way, PTL 6 allegedly enables stable production of a high-strength martensitic stainless steel seamless pipe for oil country tubular goods having a high-strength tensile property with a yield strength of 655 MPa to 862 MPa, and a yield ratio of 0.90 or more, and sufficient corrosion resistance (carbon dioxide corrosion resistance, sulfide stress corrosion cracking resistance) even in a severe, high-temperature corrosive environment of 170° C. or more containing corrosive gases such as $CO_2$ and $Cl^-$, and even $H_2S$.

PTL 7 describes a stainless steel pipe for oil country tubular goods having a composition containing, in mass %, C: 0.05% or less, Si: 1.0% or less, Mn: 0.01 to 1.0%, P: 0.05% or less, S: less than 0.002%, Cr: 16 to 18%, Mo: 1.8 to 3%, Cu: 1.0 to 3.5%, Ni: 3.0 to 5.5%, Co: 0.01 to 1.0%, Al: 0.001 to 0.1%, O: 0.05% or less, and N: 0.05% or less, in which Cr, Ni, Mo, and Cu satisfy a specific relationship. The stainless steel pipe has a microstructure that contains preferably 10% or more and less than 60% ferrite phase, 10% or less retained austenite phase, and at least 40% martensite phase by volume. In this way, PTL 7 allegedly enables stably providing a stainless steel pipe for oil country tubular goods having high strength with a yield strength of 758 MPa or more, and excellent high-temperature corrosion resistance.

PATENT LITERATURE

PTL 1: JP-A-2005-336595
PTL 2: JP-A-2008-81793
PTL 3: WO2010/050519
PTL 4: WO2010/134498
PTL 5: JP-A-2010-209402
PTL 6: JP-A-2012-149317
PTL 7: WO2013/146046

SUMMARY OF THE INVENTION

However, it cannot be said that the techniques described in PTL 1 to PTL 7 are satisfactory in terms of providing desirable low-temperature toughness, and sufficient sulfide stress cracking resistance (sulfide stress cracking resistance, or, in short, SSC resistance) in an environment with a high $H_2S$ partial pressure. This is because crystal grains coarsen in a steel pipe material that is heated before piercing to improve hot workability, and fail to provide a high low-temperature toughness value. With low low-temperature toughness, the steel pipe cannot be used in cold climates. When the heating temperature before piercing is decreased to reduce coarsening of crystal grains, the lack of ductility causes cracking in the inner and outer surfaces of the steel pipe during pipe manufacture. In oil country tubular goods using such a steel pipe, sufficient SSC resistance cannot be obtained in the event where corrosive ions accumulate in the cracked steel, or concentrate as the corrosion progresses. Indeed, it has been difficult to achieve both high low-temperature toughness and excellent SSC resistance at the same time.

In PTL 2 to PTL 7, the SSC resistance is evaluated using a round-rod test piece or a four-point bending test piece according to TM0177, Method A, of NACE (National Association of Corrosion and Engineerings). In NACE TM0177, Method A, a surface roughness of 0.25 μm or less is specified for the gauge portion. In practice, however, the actual steel pipe involves cracking in the inner and outer surfaces, and a steel pipe material that has passed an NACE TM0177 test in Method A does not necessarily passes a test conducted according to Method C.

Aspects of the present invention are intended to provide a solution to the foregoing problems of the related art, and it is an object according to aspects of the present invention to provide a high-strength stainless steel seamless pipe for oil country tubular goods having high strength with a yield strength of 862 MPa (125 ksi) or more, excellent low-temperature toughness with an absorption energy $vE_{-40}$ of 40 J or more as measured by a Charpy impact test at a test temperature of −40° C., and excellent corrosion resistance. Aspects of the invention are also intended to provide a method for manufacturing such a high-strength stainless steel seamless pipe.

As used herein, "excellent corrosion resistance" means having "excellent carbon dioxide corrosion resistance", "excellent sulfide stress corrosion cracking resistance", and "excellent sulfide stress cracking resistance".

As used herein, "excellent carbon dioxide corrosion resistance" means that a test piece dipped in a test solution (a 20 mass % NaCl aqueous solution; liquid temperature: 200° C.; 30 atm $CO_2$ gas atmosphere) charged into an autoclave has a corrosion rate of 0.127 mm/y or less after 336 hours in the solution.

As used herein, "excellent sulfide stress corrosion cracking resistance" means that a test piece dipped in a test solution (a 20 mass % NaCl aqueous solution; liquid temperature: 100° C.; a 30 atm $CO_2$ gas, and 0.1 atm $H_2S$ atmosphere) having an adjusted pH of 3.3 with addition of acetic acid and sodium acetate in an autoclave does not crack even after 720 hours under an applied stress equal to 100% of the yield stress.

As used herein, "excellent sulfide stress cracking resistance" means that a test piece dipped in a test solution (a 20 mass % NaCl aqueous solution; liquid temperature: 25° C.; a 0.9 atm $CO_2$ gas, and 0.1 atm $H_2S$ atmosphere) having an adjusted pH of 3.5 with addition of acetic acid and sodium acetate in an autoclave does not crack even after 720 hours under an applied stress equal to 90% of the yield stress.

In order to achieve the foregoing objects, the present inventors conducted intensive studies of various properties of a seamless steel pipe of a 17Cr based stainless steel composition. An alloy element such as Cr and Mo is added to the stainless steel pipe to provide excellent corrosion resistance. By high alloying, the final product has a microstructure containing retained austenite. While the retained austenite contributes to improving toughness, it leads to poor strength. After further studies to achieve high strength with a yield strength of 862 MPa or more, the present inventors thought of taking advantage of precipitation hardening using Cu precipitates and Nb precipitates, and also Ta precipitates. It was found that, in order to take advantage of such precipitation hardening, the C, N, Nb, Ta, and Cu contents need to be adjusted to satisfy the following formula (1).

$$5.1\times\{(Nb+0.5Ta)-10^{-2.2}/(C+1.2N)\}+Cu\geq 1.0, \quad \text{Formula (1)}$$

where Nb, Ta, C, N, and Cu represent the content of each element in mass %, and the content is 0 (zero) for elements that are not contained.

More specifically, the present inventors have found that the desired strength and toughness can be obtained with a stainless steel that has a specific composition and a specific microstructure, and that satisfies the foregoing formula (1)

Another finding is that hot workability improves with a composition containing more than a certain quantity of boron, and that, with such a composition, grain growth during heating can be reduced without causing defects due to reduced ductility, even when a steel pipe material is heated at a temperature of 1,200° C. or less in the production of a seamless steel pipe, as will be described later. With the fine microstructure, low-temperature toughness improves.

Aspects of the present invention are based on these findings, and were completed after further studies. Specifically, aspects of the present invention are as follows.

[1] A high-strength stainless steel seamless pipe for oil country tubular goods, the high-strength stainless steel seamless pipe having a composition that comprises, in mass %, C: 0.05% or less, Si: 1.0% or less, Mn: 0.1 to 0.5%, P: 0.05% or less, S: less than 0.005%, Cr: more than 15.0% and 19.0% or less, Mo: more than 2.0% and less than 2.8%, Cu: 0.3 to 3.5%, Ni: 3.0% or more and less than 5.0%, W: 0.1 to 3.0%, Nb: 0.07 to 0.5%, V: 0.01 to 0.5%, Al: 0.001 to 0.1%, N: 0.010 to 0.100%, O: 0.01% or less, and B: 0.0005 to 0.0100%, and in which Nb, Ta, C, N, and Cu satisfy the following formula (1), and the balance is Fe and incidental impurities, the high-strength stainless steel seamless pipe having a microstructure that is at least 45% tempered martensite phase, 20 to 40% ferrite phase, and more than 10% and 25% or less retained austenite phase by volume, the high-strength stainless steel seamless pipe having a yield strength of 862 MPa or more, and a maximum crystal grain diameter of 500 μm or less for ferrite crystal grains when crystal grains with a crystal orientation difference of within 15° are defined as the same crystal grains.

$$5.1\times\{(Nb+0.5Ta)-10^{-2.2}/(C+1.2N)\}+Cu\geq 1.0, \quad \text{Formula (1)}$$

where Nb, Ta, C, N, and Cu represent the content of each element in mass %, and the content is 0 (zero) for elements that are not contained.

[2] The high-strength stainless steel seamless pipe for oil country tubular goods according to item [1], wherein the composition further comprises, in mass %, one, two, or more selected from Ti: 0.3% or less, Zr: 0.2% or less, Co: 1.0% or less, and Ta: 0.1% or less.

[3] The high-strength stainless steel seamless pipe for oil country tubular goods according to item [1] or [2], wherein the composition further comprises, in mass %, one or two selected from Ca: 0.0050% or less, and REM: 0.01% or less.

[4] The high-strength stainless steel seamless pipe for oil country tubular goods according to any one of items [1] to [3], wherein the composition further comprises, in mass %, one, two, or more selected from Mg: 0.01% or less, Sn: 0.2% or less, and Sb: 1.0% or less.

[5] A method for manufacturing the high-strength stainless steel seamless pipe for oil country tubular goods of any one of items [1] to [4], the method comprising:

heating a steel pipe material at a heating temperature of 1,200° C. or less;

hot working the steel pipe material to make a seamless steel pipe of a predetermined shape;

quenching the seamless steel pipe in which the hot-worked seamless steel pipe is reheated in a temperature range of 850 to 1,150° C., and cooled to a cooling stop temperature at a cooling rate of air cooling or faster, the cooling stop temperature being a temperature at which a surface temperature is 50° C. or less and more than 0° C.; and tempering the seamless steel pipe by heating the seamless steel pipe at a tempering temperature of 500 to 650° C.

Aspects of the present invention have enabled production of a high-strength stainless steel seamless pipe having high strength with a yield strength of 862 MPa (125 ksi) or more, and excellent low-temperature toughness with an absorption energy $vE_{-40}$ of 40 J or more as measured by a Charpy impact test at a test temperature of −40° C. The high-strength stainless steel seamless pipe also has excellent corrosion resistance, specifically, excellent carbon dioxide corrosion resistance even in a severe, high-temperature corrosive environment of 200° C. or more containing $CO_2$ and $Cl^-$, and excellent sulfide stress corrosion cracking resistance, and excellent sulfide stress cracking resistance.

DETAILED DESCRIPTION OF EMBODIMENTS OF THE INVENTION

A seamless steel pipe according to aspects of the present invention is a stainless steel seamless pipe for oil country tubular goods having a composition that contains, in mass %, C: 0.05% or less, Si: 1.0% or less, Mn: 0.1 to 0.5%, P: 0.05% or less, S: less than 0.005%, Cr: more than 15.0% and 19.0% or less, Mo: more than 2.0% and less than 2.8%, Cu: 0.3 to 3.5%, Ni: 3.0% or more and less than 5.0%, W: 0.1 to 3.0%, Nb: 0.07 to 0.5%, V: 0.01 to 0.5%, Al: 0.001 to 0.1%, N: 0.010 to 0.100%, O: 0.01% or less, and B: 0.0005 to 0.0100%, and in which Nb, Ta, C, N, and Cu satisfy the following formula (1), and the balance is Fe and incidental impurities, and having a microstructure that is at least 45% tempered martensite phase, 20 to 40% ferrite phase, and more than 10% and 25% or less retained austenite phase by volume.

$$5.1\times\{(Nb+0.5Ta)-10^{-2.2}/(C+1.2N)\}+Cu\geq 1.0, \quad \text{Formula (1)}$$

where Nb, Ta, C, N, and Cu represent the content of each element in mass %, and the content is 0 (zero) for elements that are not contained.

The reasons for specifying the composition of the seamless steel pipe according to aspects of the present invention are as follows. In the following, "%" means percent by mass, unless otherwise specifically stated.

C: 0.05% or Less

C is an important element to increase the strength of the martensitic stainless steel. In accordance with aspects of the present invention, C is contained in an amount of desirably 0.010% or more to provide the desired high strength. AC content of more than 0.05% impairs the corrosion resistance. For this reason, the C content is 0.05% or less. Preferably, the C content is 0.015% or more. Preferably, the C content is 0.04% or less.

Si: 1.0% or Less

Si is an element that acts as a deoxidizing agent. It is desirable to contain Si in an amount of 0.005% or more to obtain this effect. A Si content of more than 1.0% impairs hot workability. For this reason, the Si content is 1.0% or less. Preferably, the Si content is 0.1% or more. Preferably, the Si content is 0.6% or less.

Mn: 0.1 to 0.5%

Mn is an element that increases the strength of the martensitic stainless steel. Mn needs to be contained in an amount of 0.1% or more to provide the desired strength. A Mn content of more than 0.5% impairs toughness. For this reason, the Mn content is 0.1 to 0.5%. Preferably, the Mn content is 0.4% or less.

P: 0.05% or Less

In accordance with aspects of the present invention, P should preferably be contained in as small an amount as possible because this element impairs corrosion resistance, including carbon dioxide corrosion resistance, and sulfide stress cracking resistance. However, a P content of 0.05% or less is acceptable. For this reason, the P content is 0.05% or less. Preferably, the P content is 0.02% or less.

S: Less Than 0.005%

Preferably, S should be contained in as small an amount as possible because this element is highly detrimental to hot workability, and interferes with a stabilized operating condition of the hot pipe making process. However, a S content of less than 0.005% is acceptable. For this reason, the S content is less than 0.005%. The S content is preferably 0.002% or less.

Cr: More Than 15.0% and 19.0% or Less

Cr is an element that forms a protective coating on a steel pipe surface, and contributes to improving corrosion resistance. The desired corrosion resistance cannot be provided when the Cr content is 15.0% or less. For this reason, Cr needs to be contained in an amount of more than 15.0%. With a Cr content of more than 19.0%, the ferrite fraction becomes overly high, and it is not possible to provide the desired strength. For this reason, the Cr content is more than 15.0% and 19.0% or less. Preferably, the Cr content is 16.0% or more. Preferably, the Cr content is 18.0% or less.

Mo: More than 2.0% and Less than 2.8%

Mo is an element that improves resistance to pitting corrosion resistance due to $Cl^-$ and low pH, and improves the sulfide stress cracking resistance, and the sulfide stress corrosion cracking resistance by stabilizing the protective coating on a steel pipe surface. Mo needs to be contained in an amount of more than 2.0% to obtain these effects. Mo is an expensive element, and a Mo content of 2.8% or more increases the material cost, and leads to poor toughness, and poor sulfide stress cracking resistance. For this reason, the Mo content is more than 2.0% and less than 2.8%. Preferably, the Mo content is 2.2% or more. Preferably, the Mo content is 2.7% or less.

Cu: 0.3 to 3.5%

Cu increases the retained austenite, and contributes to improving yield strength by forming precipitates. This makes Cu a very important element that provides high strength without deteriorating low-temperature toughness. Cu also reduces hydrogen penetration in the steel by enhancing the strength of the protective coating on a steel pipe surface, and has the effect to increase the sulfide stress cracking resistance, and the sulfide stress corrosion cracking resistance. Cu needs to be contained in an amount of 0.3% or more to obtain such effects. A Cu content of more than 3.5% leads to precipitation of CuS at grain boundaries, and impairs hot workability. For this reason, the Cu content is 0.3 to 3.5%. Preferably, the Cu content is 0.5% or more. Preferably, the Cu content is 1.0% or more. Preferably, the Cu content is 3.0% or less.

Ni: 3.0% or More and Less Than 5.0%

Ni is an element that adds strength to the protective coating on a steel pipe surface, and contributes to improving corrosion resistance. Ni also increases steel strength through solid solution strengthening. Such effects become more notable when the Ni content is 3.0% or more. With a Ni content of 5.0% or more, the stability of the martensite phase decreases, and the strength decreases. For this reason, the Ni content is 3.0% or more and less than 5.0%. Preferably, the Ni content is 3.5% or more. Preferably, the Ni content is 4.5% or less.

W: 0.1 to 3.0%

W is an important element that contributes to improving steel strength, and stabilizes the protective coating on a steel pipe surface to improve the sulfide stress cracking resistance, and the sulfide stress corrosion cracking resistance. When contained together with Mo, W greatly improves the sulfide stress cracking resistance. W needs to be contained in an amount of 0.1% or more to obtain such effects. A W content of more than 3.0% deteriorates toughness. For this reason, the W content is 0.1 to 3.0%. Preferably, the W content is 0.5% or more. Preferably, the W content is 0.8% or more. Preferably, the W content is 2.0% or less.

Nb: 0.07 to 0.5%

Nb contributes to improving yield strength by precipitating a Nb carbonitride (Nb precipitate) by binding to C and N. This makes Nb an important element in accordance with aspects of the present invention. Nb needs to be contained in an amount of 0.07% or more to obtain these effects. A Nb content of more than 0.5% leads to poor toughness, and poor sulfide stress cracking resistance. For this reason, the Nb content is 0.07 to 0.5%. Preferably, the Nb content is 0.07 to 0.2%.

V: 0.01 to 0.5%

V is an element that contributes to improving strength through solid solution strengthening. V also contributes to improving yield strength by precipitating a V carbonitride (V precipitate) by binding to C and N. V needs to be contained in an amount of 0.01% or more to obtain these effects. A V content of more than 0.5% leads to poor toughness, and poor sulfide stress cracking resistance. For this reason, the V content is 0.01 to 0.5%. Preferably, the V content is 0.02% or more. Preferably, the V content is 0.1% or less.

Al: 0.001 to 0.1%

Al is an element that acts as a deoxidizing agent. Al needs to be contained in an amount of 0.001% or more to obtain this effect. The oxide amount increases when the Al content is more than 0.1%. This deteriorates cleanliness, and leads to poor toughness. For this reason, the Al content is 0.001 to 0.1%. Preferably, the Al content is 0.01% or more. Preferably, the Al content is 0.02% or more. Preferably, the Al content is 0.07% or less.

N: 0.010 to 0.100%

N is an element that improves the pitting corrosion resistance. N is contained in an amount of 0.010% or more to obtain this effect. A N content of more than 0.100% results in formation of nitrides, and the toughness deteriorates. For this reason, the N content is 0.010 to 0.100%. Preferably, the N content is 0.020% or more. Preferably, the N content is 0.06% or less.

O: 0.01% or Less

O(Oxygen) exists as an oxide in the steel, and has adverse effect on various properties. The O content should therefore be reduced as much as possible in accordance with aspects of the present invention. Particularly, hot workability, corrosion resistance, and toughness deteriorates when the O content is more than 0.01%. For this reason, the O content is 0.01% or less.

B: 0.0005 to 0.0100%

B contributes to increasing strength, and improving hot workability. With these effects, B reduces cracking in the pipe manufacturing process, and the SSC resistance improves in an SSC test that uses a test piece having the inner and outer surfaces of an as-produced steel pipe, such as in NACE TM0177, Method C. B is contained in an amount of 0.0005% or more to obtain these effects. A B content of more than 0.0100% produces only a marginal additional hot-workability improving effect, if any, and deteriorates low-temperature toughness. For this reason, the B content is 0.0005 to 0.0100%. Preferably, the B content is 0.001% or more. Preferably, the B content is 0.008% or less. More preferably, the B content is 0.0015% or more. More preferably, the B content is 0.007% or less.

In accordance with aspects of the present invention, Nb, Ta, C, N, and Cu are contained in adjusted amounts that satisfy the following formula (1) in the foregoing content ranges.

$$5.1\times\{(Nb+0.5Ta)-10^{-2.2}/(C+1.2N)\}+Cu\geq 1.0, \qquad \text{Formula (1)}$$

where Nb, Ta, C, N, and Cu represent the content of each element in mass %, and the content is 0 (zero) for elements that are not contained.

When the value on the left-hand side of the formula (1) is less than 1.0, Cu, Nb, and Ta form only small amounts of precipitates, and the precipitation hardening becomes insufficient, the desired strength cannot be provided. For this reason, in accordance with aspects of the present invention, the Nb, Ta, C, N, and Cu contents are adjusted so that the value on the left-hand side of the formula (1) is 1.0 or more. As noted above, the content of an element on the left-hand side of formula (1) is 0 (zero) when it is not contained. Preferably, the value on the left-hand side of the formula (1) is 2.0 or more.

In addition to the foregoing components, the composition contains the balance Fe and incidental impurities in accordance with aspects of the present invention.

In accordance with aspects of the present invention, one, two, or more selected from Ti: 0.3% or less, Zr: 0.2% or less, Co: 1.0% or less, and Ta: 0.1% or less may be optionally contained in the foregoing basic composition. The composition may also contain one or two optional element selected from Ca: 0.0050% or less, and REM: 0.01% or less. The composition may also contain one, two, or more optional element selected from Mg: 0.01% or less, Sn: 0.2% or less, and Sb: 1.0% or less.

One, Two or More Selected from Ti: 0.3% or Less, Zr: 0.2% or Less, Co: 1.0% or Less, and Ta: 0.1% or Less Ti, Zr, Co, and Ta are elements that increase strength, and one, two, or more of these may be selected and contained, as needed. In addition to this effect, Ti, Zr, Co, and Ta have the effect to improve the sulfide stress cracking resistance. Particularly, Ta has the same effect as Nb, and Nb may be partially replaced with Ta. In order to obtain these effects, it is desirable to contain these elements in amounts of 0.01% or more for Ti, 0.01% or more for Zr, 0.01% or more for Co, and 0.01% or more for Ta. Toughness decreases when Ti, Zr, Co, and Ta are contained more than 0.3%, 0.2%, 1.0%, and 0.1%, respectively. For this reason, Ti, Zr, Co, and Ta, when contained, are contained in limited amounts of preferably 0.3% or less for Ti, 0.2% or less for Zr, 1.0% or less for Co, and 0.1% or less for Ta.

One or Two Selected from Ca: 0.0050% or Less, and REM: 0.01% or Less

Ca and REM are elements that contribute to improving sulfide stress corrosion cracking resistance by controlling the form of sulfide, and one or two of these elements may be contained, as needed. In order to obtain this effect, it is desirable to contain these elements in amounts of 0.0001% or more for Ca, and 0.001% or more for REM. When the Ca content and the REM content are more than 0.0050% and more than 0.01%, respectively, the effect becomes saturated, and these elements cannot provide an additional effect proportional to the contents. For this reason, Ca and REM, when contained, are contained in limited amounts of preferably 0.0050% or less for Ca, and 0.01% or less for REM.

One, Two, or More Selected from Mg: 0.01% or Less, Sn: 0.2% or Less, and Sb: 1.0% or Less Mg, Sn, and Sb are elements that improve corrosion resistance, and one, two, or more of these may be selected and contained, as needed. In order to obtain this effect, it is desirable to contain these elements in amounts of 0.002% or more for Mg, 0.01% or more for Sn, and 0.01% or more for Sb. When the Mg content, the Sn content, and the Sb content are more than 0.01%, more than 0.2%, and more than 1.0%, respectively, the effect becomes saturated, and these elements cannot provide an additional effect proportional to the contents. For this reason, Mg, Sn, and Sb, when contained, are contained in limited amounts of preferably 0.01% or less for Mg, 0.2% or less for Sn, and 1.0% or less for Sb.

The following describes the reasons for specifying the microstructure of the seamless steel pipe according to aspects of the present invention.

In addition to the foregoing composition, the seamless steel pipe according to aspects of the present invention has a microstructure that is at least 45% tempered martensite phase (dominant phase), 20 to 40% ferrite phase, and more than 10% and 25% or less retained austenite phase by volume.

In the seamless steel pipe according to aspects of the present invention, the dominant phase is the tempered martensite phase, and the volume fraction of the tempered martensite phase is 45% or more to provide the desired strength. In accordance with aspects of the present invention, at least 20% by volume of ferrite phase is precipitated at least as a secondary phase. In this way, it is possible to prevent a defect that occurs when the strain introduced at the time of hot rolling concentrates on the soft ferrite phase. With the ferrite phase precipitated in at least 20% by volume, it is possible to reduce propagation of sulfide stress corrosion cracking and sulfide stress cracking, and the desired corrosion resistance can be provided. The desired strength may not be obtained when the ferrite phase precipitates in more than 40% by volume. The volume fraction of the ferrite phase is therefore 20 to 40%.

In the seamless steel pipe according to aspects of the present invention, the austenite phase (retained austenite phase) is precipitated as a secondary phase, in addition to the ferrite phase. Ductility and toughness improve when the retained austenite phase is present. In order to improve ductility and toughness while providing the desired strength, the retained austenite phase is precipitated in more than 10% by volume. The desired strength cannot be provided when the austenite phase precipitates in large amounts of more than 25% by volume. For this reason, the volume fraction of the retained austenite phase is 25% or less. Preferably, the volume fraction of the retained austenite phase is more than 10% and 20% or less.

For the measurement of the microstructure of the seamless steel pipe according to aspects of the present invention, a test piece for microstructure observation is corroded with Vilella's reagent (a mixed reagent containing 2 g of picric acid, 10 ml of hydrochloric acid, and 100 ml of ethanol), and the microstructure is imaged with a scanning electron microscope (magnification: 1,000 times). The fraction of the ferrite phase microstructure (volume %) is then calculated with an image analyzer.

A test piece for X-ray diffraction is ground and polished to provide a measurement cross sectional surface (C cross section) orthogonal to the pipe axis direction, and the volume of retained austenite (γ) is measured by X-ray diffractometry. The retained austenite volume is calculated by measuring the diffraction X-ray integral intensities of the γ (220) plane and the α (211) plane, and converting the results using the following equation.

$$\gamma(\text{volume fraction})=100/(1+(I\alpha R\gamma/I\gamma R\alpha))$$

In the equation, Iα represents the integral intensity of α, Rα represents a crystallographic theoretical calculation value for α, Iγ represents the integral intensity of γ, and Rγ represents a crystallographic theoretical calculation value for γ.

The fraction of the tempered martensite phase is the remainder other than the fractions of the ferrite phase and the retained γ phase determined in the manner described above.

The high-strength stainless steel seamless pipe for oil country tubular goods according to aspects of the present invention has a maximum crystal grain diameter of 500 μm or less for ferrite crystal grains when crystal grains with a crystal orientation difference of within 15° are defined as the same crystal grains. The crystal grain boundary, which blocks crack propagation, will be present in fewer numbers when the maximum crystal grain diameter of ferrite crystal grains is more than 500 μm. In this case, the desired low-temperature toughness cannot be obtained. For this reason, in accordance with aspects of the present invention, the maximum crystal grain diameter of ferrite crystal grains is 500 μm or less when crystal grains with a crystal orientation difference of within 15° are defined as the same crystal grains. The maximum crystal grain diameter of ferrite crystal grains is preferably 400 μm or less, more preferably 350 μm or less.

The maximum crystal grain diameter can be determined as follows. In a crystal orientation measurement conducted for a 100-$mm^2$ continuous region by electron backscatter diffraction (EBSD), crystal grains having a crystal orientation difference of within 15° are defined as the same crystal grains, and the maximum diameters of ferrite crystal grains that were determined as the same crystal grains are regarded as the crystal grain diameters of the ferrite crystal grains. The largest value of the crystal grain diameters of all crystals in the 100-$mm^2$ region can then be determined as the maximum crystal grain diameter. In accordance with aspects of the present invention, the maximum crystal grain diameter of ferrite crystal grains as measured by EBSD can be adjusted to 500 μm or less by heating a steel pipe material before hot working at a heating temperature of 1,200° C. or less, as will be described later.

A method for manufacturing the high-strength stainless steel seamless pipe for oil country tubular goods according to aspects of the present invention includes: heating a steel pipe material at a heating temperature of 1,200° C. or less; hot working the steel pipe material to make a seamless steel pipe of a predetermined shape; quenching the seamless steel pipe in which the hot-worked seamless steel pipe is reheated in a temperature range of 850 to 1,150° C., and cooled to a cooling stop temperature at a cooling rate of air cooling or faster, the cooling stop temperature being a temperature at which a surface temperature is 50° C. or less and more than 0° C.; and tempering the seamless steel pipe by heating the seamless steel pipe at a tempering temperature of 500 to 650° C.

A high-strength stainless steel seamless pipe for oil country tubular goods is typically produced by piercing a steel pipe material (e.g., a billet) using a common known tubing manufacturing method, specifically, the Mannesmann-plug mill method or the Mannesmann-mandrel mill method. The steel pipe material is heated to a temperature high enough to provide sufficient ductility because a low steel-pipe-material temperature during piercing often causes defects such as dents, holes, and cracks due to low ductility. However, heating at high temperature causes coarse crystal grain growth, and produces coarse crystal grains also in the microstructure of the final product, with the result that the desired low-temperature toughness value cannot be obtained.

In accordance with aspects of the present invention, however, the composition containing more than a certain quantity of B improves hot workability, and the grain growth during heating can be reduced without causing defects due to reduced ductility, even though a steel pipe material is heated at a temperature of 1,200° C. or less. This produces a fine microstructure, and a desirable low-temperature toughness value can be obtained.

A method for manufacturing a high-strength stainless steel seamless pipe for oil country tubular goods according to aspects of the present invention is described below. The method is not particularly limited to the following, except for the heating temperature of the steel pipe material.

Preferably, a molten steel of the foregoing composition is made into steel using an ordinary steel making process such as by using a converter, and formed into a steel pipe material, for example, a billet, using an ordinary method such as continuous casting, or ingot casting-blooming. The steel pipe material is heated to a temperature of 1,200° C. or less, and hot worked using typically a known pipe manufacturing process, for example, the Mannesmann-plug mill process, or the Mannesmann-mandrel mill process to produce a seamless steel pipe of the foregoing composition and of the desired dimensions. Here, when the heat applied during hot working to improve ductility and reduce defects is high temperature, coarse crystal grain growth occurs, and the maximum crystal grain diameter of ferrite crystal grains becomes more than 500 μm, with the result that the low-temperature toughness of the final product decreases. It is therefore required to make the heating temperature of the steel pipe material 1,200° C. or less, preferably 1,180° C. or less, more preferably 1,150° C. or less. With a heating temperature of less than 1,050° C., the workability of the steel material becomes considerably poor, and it becomes difficult, even with the steel according to aspects of the present invention, to make a pipe without damaging the outer surface. The heating temperature of the steel pipe material is therefore preferably 1,050° C. or more, more preferably 1,100° C. or more.

The hot working may be followed by cooling. The cooling process is not particularly limited. With the composition range according to aspects of the present invention, cooling the hot-worked steel pipe to room temperature at a cooling rate about the same as the rate of air cooling can produce a steel pipe microstructure containing a tempered martensite phase as a dominant phase.

In accordance with aspects of the present invention, this is followed by a heat treatment that includes quenching and tempering.

The quenching is a process in which the steel pipe is reheated in a heating temperature range of 850 to 1,150° C., and cooled to a cooling stop temperature at a cooling rate of air cooling or faster, the cooling stop temperature being a temperature at which the surface temperature is 50° C. or less and more than 0° C. When the heating temperature is less than 850° C., reverse transformation from martensite to austenite does not occur, and the transformation of austenite to martensite does not take place upon cooling, with the result that the desired strength cannot be provided. Crystal grains coarsen when the heating temperature is higher than 1,150° C. For this reason, the heating temperature of quenching is 850 to 1,150° C. Preferably, the heating temperature of quenching is 900° C. or more. Preferably, the heating temperature of quenching is 1,000° C. or less.

When the cooling stop temperature is more than 50° C., the transformation of austenite to martensite does not sufficiently take place, and the austenite fraction becomes overly large. When the cooling stop temperature is 0° C. or less, the transformation into martensite overly takes place, and the necessary austenite fraction cannot be obtained. For this reason, in accordance with aspects of the present invention, the cooling stop temperature of cooling in quenching is 50° C. or less and more than 0° C.

Here, "cooling rate of air cooling or faster" means 0.01° C./s or more.

In quenching, the soaking time is preferably 5 to 30 minutes, so that the temperature in wall thickness direction becomes uniform, and material fluctuations can be prevented.

The tempering is a process in which the quenched seamless steel pipe is heated at a tempering temperature of 500 to 650° C. The heating may be followed by natural cooling. A tempering temperature of less than 500° C. is too low to provide the desired tempering effect. When the tempering temperature is higher than 650° C., an as-quenched martensite phase occurs, and the product cannot have the desired high strength and high toughness, and excellent corrosion resistance. For this reason, the tempering temperature is 500 to 650° C. Preferably, the tempering temperature is 520° C. or more. Preferably, the tempering temperature is 630° C. or less.

In tempering, the holding time is preferably 5 to 90 minutes, so that the temperature in wall thickness direction becomes uniform, and material fluctuations can be prevented.

After the heat treatment (quenching and tempering), the seamless steel pipe has a microstructure that contains the tempered martensite phase as a dominant phase, and in which the ferrite phase and the retained austenite phase are present. This makes it possible to provide a high-strength stainless steel seamless pipe for oil country tubular goods having the desired strength and toughness, and excellent corrosion resistance.

The high-strength stainless steel seamless pipe for oil country tubular goods provided in accordance with aspects of the present invention has a yield strength of 862 MPa or more, and excellent low-temperature toughness, and excellent corrosion resistance. Preferably, the yield strength is 1,034 MPa or less.

Example 1

The present invention is further described below through Examples.

Molten steels of the compositions shown in Table 1 were made into steel with a converter, and cast into billets (steel pipe material) by continuous casting. The steel pipe material was then heated, and hot worked with a model seamless rolling mill to produce a seamless steel pipe measuring 83.8 mm in outer diameter and 12.7 mm in wall thickness. This was followed by air cooling. The heating temperature of the steel pipe material before hot working is as shown in Table 2.

Each seamless steel pipe was cut to obtain a test piece material, which was then subjected to quenching, in which the test piece material was heated and cooled under the conditions shown in Table 2. This was followed by tempering, in which the test piece material was heated and air cooled under the conditions shown in Table 2. The cooling rate was 11° C./s for the water cooling of quenching, and 0.04° C./s for the air cooling (natural cooling) of tempering.

A test piece was taken from the heat-treated test material (seamless steel pipe), and subjected to microstructure observation, a tensile test, an impact test, and a corrosion resistance test. The tests were conducted in the manners described below.

(1) Microstructure Observation

A test piece for microstructure observation was taken from the heat-treated test material in such an orientation that the cross section along the pipe axis direction was the observed surface. The test piece for microstructure observation was corroded with Vilella's reagent (a mixed reagent containing 2 g of picric acid, 10 ml of hydrochloric acid, and 100 ml of ethanol). The microstructure was imaged with a scanning electron microscope (magnification: 1,000 times), and the fraction of the ferrite phase microstructure (volume %) was calculated with an image analyzer.

A test piece for X-ray diffraction was taken from the heat-treated test material, and ground and polished to provide a measurement surface on a cross section (C cross section) orthogonal to the pipe axis direction. The surface was then measured for the amount of retained austenite (γ) by X-ray diffractometry. The amount of retained austenite was found by measuring the diffraction X-ray integral intensities of the γ (220) plane and the α (211) plane. The results were then converted using the following equation.

$$\gamma(\text{volume fraction})=100/(1+(I\alpha R\gamma/I\gamma R\alpha))$$

In the equation, Iα represents the integral intensity of α, Rα represents a crystallographic theoretical calculation value for α, Iγ represents the integral intensity of γ, and Rγ represents a crystallographic theoretical calculation value for γ.

The fraction of the tempered martensite phase is the remainder other than the ferrite phase and the retained γ phase.

In a crystal orientation measurement conducted for a 100-mm$^2$ continuous region by electron backscatter diffraction (EBSD), crystal grains having a crystal orientation difference of within 15° were defined as the same crystal grains, and the maximum diameters of ferrite crystal grains that were determined as the same crystal grains was regarded as the crystal grain diameters of the ferrite crystal grains. The largest value of the crystal grain diameters of all crystals in the 100-$mm^2$ region was then determined as the maximum crystal grain diameter.

(2) Tensile Test

An arc-shaped tensile test specimen specified by API (American Petroleum Institute) standard was taken from the heat-treated test material in such an orientation that the pipe axis direction was the tensile direction. The specimen was then subjected to a tensile test according to the API specification to determine its tensile properties (yield strength, YS; tensile strength, TS). Samples with a yield strength YS of 862 MPa or more were determined as having high strength and being acceptable. Samples with a yield strength YS of less than 862 MPa were rejected.

(3) Impact Test

A V-notch test piece (10 mm thick) was taken from the heat-treated test material according to the JIS Z 2242 standard. The test piece was taken in such an orientation that the longitudinal direction of the test piece was the pipe axis direction. The test piece was subjected to a Charpy impact test. The test was conducted at −40° C., and the absorption energy $vE_{-40}$ at −40° C. was determined for toughness evaluation. The arithmetic mean value of absorption energy values from three test pieces was calculated as the absorption energy (J) of the steel pipe. Samples with an absorption energy $vE_{-40}$ at −40° C. of 40 J or more were determined as having high toughness and being acceptable. Samples with an absorption energy $vE_{-40}$ at −40° C. of less than 40 J were rejected.

(4) Corrosion Resistance Test

A corrosion test piece measuring 3 mm in wall thickness, 30 mm in width, and 40 mm in length was machined from the heat-treated test material, and subjected to a corrosion test. The test was conducted to evaluate the carbon dioxide corrosion resistance.

The corrosion test was conducted by dipping the corrosion test piece for 14 days (336 hours) in a test solution (a 20 mass % NaCl aqueous solution; liquid temperature: 200° C., a 30-atm $CO_2$ gas atmosphere) charged into an autoclave. After the test, the weight of the test piece was measured, and the corrosion rate was determined from the calculated weight reduction before and after the corrosion test. Samples with a corrosion rate of 0.127 mm/y or less were determined as being acceptable. Samples with a corrosion rate of more than 0.127 mm/y were rejected.

The test piece after the corrosion test was observed for the presence or absence of pitting corrosion on a test piece surface using a loupe (10 times magnification). Corrosion with a diameter of 0.2 mm or more was regarded as pitting corrosion. Samples with no pitting corrosion were determined as being acceptable. Samples with pitting corrosion were rejected.

A C-shaped test piece was machined from the test piece material according to NACE TM0177, Method C, and subjected to a sulfide stress cracking (SSC) resistance test. The curved surfaces, which correspond to the inner and outer surfaces of the steel pipe, were not ground or polished.

In the SSC resistance test, a test piece was dipped in a test solution (a 20 mass % NaCl aqueous solution; liquid temperature: 25° C.; atmosphere of $H_2S$: 0.1 atm; and $CO_2$: 0.9 atm) having an adjusted pH of 3.5 with addition of acetic acid and sodium acetate in an autoclave. The test piece was dipped for 720 hours under an applied stress equal to 90% of the yield stress. After the test, the test piece was observed for the presence or absence of cracking. Samples with no cracks were determined as being acceptable (Pass). Samples with cracks were rejected (Fail).

A four-point bending test piece measuring 3 mm in wall thickness, 15 mm in width, and 115 mm in length was taken by machining the test piece material, and subjected to a sulfide stress corrosion cracking (SCC) resistance test according to EFC (European Federation of Corrosion) 17.

In the SCC resistance test, a test piece was dipped in a test solution (a 20 mass % NaCl aqueous solution; liquid temperature: 100° C.; atmosphere of $H_2S$: 0.1 atm; and $CO_2$: 30 atm) having an adjusted pH of 3.3 with addition of acetic acid and sodium acetate in an autoclave. The test piece was dipped for 720 hours under an applied stress equal to 100% of the yield stress. After the test, the test piece was observed for the presence or absence of cracking. Samples with no cracks were determined as being acceptable (Pass). Samples with cracks were rejected (Fail).

The results are presented in Table 2.

TABLE 1

| Steel | Composition (mass %) | | | | | | | | | | | | | | |
|---|---|---|---|---|---|---|---|---|---|---|---|---|---|---|---|
| No. | C | Si | Mn | P | S | Cr | Mo | Cu | Ni | W | Nb | V | Al | N | O |
| A | 0.020 | 0.25 | 0.30 | 0.015 | 0.0010 | 16.5 | 2.4 | 2.5 | 3.6 | 1.10 | 0.10 | 0.06 | 0.031 | 0.050 | 0.0030 |
| B | 0.025 | 0.26 | 0.30 | 0.014 | 0.0009 | 16.0 | 2.5 | 1.8 | 3.5 | 1.30 | 0.19 | 0.12 | 0.041 | 0.056 | 0.0026 |
| C | 0.027 | 0.25 | 0.30 | 0.015 | 0.0006 | 17.1 | 2.4 | 2.6 | 4.1 | 1.10 | 0.27 | 0.09 | 0.039 | 0.038 | 0.0048 |
| D | 0.030 | 0.25 | 0.30 | 0.015 | 0.0011 | 17.2 | 2.5 | 2.2 | 3.8 | 1.60 | 0.15 | 0.21 | 0.043 | 0.077 | 0.0031 |
| E | 0.026 | 0.25 | 0.30 | 0.015 | 0.0009 | 16.6 | 2.5 | 2.7 | 3.6 | 1.70 | 0.26 | 0.22 | 0.041 | 0.059 | 0.0027 |
| F | 0.027 | 0.24 | 0.30 | 0.015 | 0.0009 | 18.4 | 2.5 | 2.5 | 3.7 | 1.10 | 0.26 | 0.18 | 0.045 | 0.063 | 0.0020 |
| G | 0.025 | 0.26 | 0.30 | 0.015 | 0.0015 | 15.7 | 2.4 | 2.8 | 3.9 | 0.40 | 0.33 | 0.07 | 0.035 | 0.064 | 0.0028 |
| H | 0.022 | 0.25 | 0.31 | 0.016 | 0.0014 | 17.2 | 2.6 | 3.1 | 3.7 | 2.30 | 0.24 | 0.28 | 0.038 | 0.081 | 0.0028 |
| I | 0.028 | 0.26 | 0.30 | 0.015 | 0.0011 | 17.5 | 2.4 | 0.5 | 3.4 | 1.90 | 0.19 | 0.21 | 0.033 | 0.084 | 0.0024 |
| J | 0.021 | 0.25 | 0.30 | 0.015 | 0.0017 | 16.9 | 2.5 | 2.4 | 4.6 | 1.30 | 0.34 | 0.11 | 0.035 | 0.056 | 0.0049 |
| K | 0.025 | 0.25 | 0.30 | 0.015 | 0.0011 | 17.0 | 2.5 | 2.5 | 3.1 | 0.60 | 0.22 | 0.09 | 0.039 | 0.048 | 0.0030 |
| L | 0.024 | 0.25 | 0.30 | 0.015 | 0.0010 | 17.2 | 2.5 | 1.1 | 4.2 | 1.40 | 0.19 | 0.27 | 0.040 | 0.051 | 0.0032 |
| M | 0.026 | 0.25 | 0.30 | 0.016 | 0.0009 | 16.3 | 2.7 | 2.5 | 3.6 | 1.70 | 0.41 | 0.29 | 0.033 | 0.081 | 0.0023 |
| N | 0.029 | 0.24 | 0.31 | 0.015 | 0.0011 | 17.2 | 2.2 | 1.6 | 3.5 | 0.80 | 0.16 | 0.36 | 0.037 | 0.039 | 0.0027 |
| O | 0.031 | 0.26 | 0.30 | 0.014 | 0.0008 | 17.0 | 2.4 | 2.9 | 3.9 | 2.40 | 0.29 | 0.09 | 0.038 | 0.054 | 0.0023 |
| P | 0.021 | 0.25 | 0.29 | 0.015 | 0.0014 | 16.8 | 2.5 | 1.0 | 4.0 | 1.20 | 0.17 | 0.29 | 0.042 | 0.033 | 0.0045 |
| Q | 0.027 | 0.25 | 0.30 | 0.015 | 0.0012 | 17.3 | 2.5 | 1.3 | 3.9 | 1.30 | 0.20 | 0.25 | 0.040 | 0.066 | 0.0026 |
| R | 0.028 | 0.25 | 0.30 | 0.015 | 0.0010 | 17.1 | 2.5 | 2.2 | 3.7 | 0.40 | 0.32 | 0.14 | 0.041 | 0.058 | 0.0028 |
| S | 0.024 | 0.24 | 0.30 | 0.015 | 0.0011 | 16.4 | 2.6 | 1.7 | 3.9 | 2.10 | 0.25 | 0.21 | 0.048 | 0.065 | 0.0023 |
| T | 0.027 | 0.25 | 0.30 | 0.015 | 0.0009 | 17.0 | 2.5 | 2.6 | 4.1 | 1.20 | 0.17 | 0.09 | 0.041 | 0.050 | 0.0032 |
| U | 0.025 | 0.25 | 0.30 | 0.016 | 0.0008 | 16.0 | 2.5 | 0.9 | 3.6 | 1.60 | 0.18 | 0.26 | 0.040 | 0.058 | 0.0020 |
| V | 0.028 | 0.25 | 0.30 | 0.014 | 0.0010 | 16.7 | 2.5 | 2.3 | 2.6 | 1.30 | 0.12 | 0.05 | 0.038 | 0.062 | 0.0030 |
| W | 0.027 | 0.26 | 0.30 | 0.014 | 0.0008 | 16.8 | 1.7 | 2.0 | 3.5 | 1.60 | 0.21 | 0.16 | 0.033 | 0.080 | 0.0028 |

TABLE 1-continued

| | | | | | | | | | | | | | | | |
|---|---|---|---|---|---|---|---|---|---|---|---|---|---|---|---|
| X | 0.026 | 0.25 | 0.30 | 0.015 | 0.0006 | 19.5 | 2.6 | 1.8 | 4.1 | 1.10 | 0.25 | 0.18 | 0.035 | 0.081 | 0.0024 |
| Y | 0.026 | 0.25 | 0.30 | 0.015 | 0.0010 | 15.7 | 2.5 | 2.1 | 5.2 | 1.20 | 0.18 | 0.17 | 0.039 | 0.060 | 0.0051 |
| Z | 0.022 | 0.25 | 0.30 | 0.015 | 0.0009 | 15.9 | 3.1 | 2.6 | 4.3 | 1.40 | 0.17 | 0.20 | 0.031 | 0.044 | 0.0048 |
| AA | 0.031 | 0.24 | 0.30 | 0.014 | 0.0008 | 17.2 | 2.6 | 4.0 | 4.4 | 1.10 | 0.26 | 0.16 | 0.041 | 0.077 | 0.0031 |
| AB | 0.029 | 0.26 | 0.30 | 0.015 | 0.0015 | 14.3 | 2.5 | 2.9 | 4.1 | 1.00 | 0.28 | 0.10 | 0.039 | 0.059 | 0.0027 |
| AC | 0.026 | 0.25 | 0.31 | 0.016 | 0.0014 | 16.9 | 2.4 | 0.1 | 3.8 | 1.60 | 0.30 | 0.16 | 0.043 | 0.063 | 0.0026 |
| AD | 0.027 | 0.25 | 0.30 | 0.015 | 0.0011 | 16.3 | 2.6 | 2.0 | 4.1 | 1.30 | 0.05 | 0.07 | 0.040 | 0.046 | 0.0030 |
| AE | 0.024 | 0.26 | 0.30 | 0.015 | 0.0010 | 16.1 | 2.2 | 2.1 | 3.6 | 1.50 | 0.27 | — | 0.041 | 0.041 | 0.0048 |
| AF | 0.030 | 0.25 | 0.30 | 0.014 | 0.0017 | 16.8 | 2.3 | 1.6 | 3.8 | 0.06 | 0.29 | 0.20 | 0.045 | 0.077 | 0.0031 |
| AG | 0.027 | 0.25 | 0.30 | 0.015 | 0.0010 | 17.4 | 2.5 | 1.4 | 3.5 | 1.30 | 0.24 | 0.18 | 0.035 | 0.060 | 0.0021 |
| AH | 0.028 | 0.25 | 0.30 | 0.015 | 0.0010 | 16.5 | 2.8 | 2.0 | 3.9 | 1.20 | 0.23 | 0.26 | 0.038 | 0.063 | 0.0020 |
| AI | 0.016 | 0.25 | 0.30 | 0.014 | 0.0010 | 15.8 | 2.6 | 1.0 | 4.0 | 1.10 | 0.10 | 0.27 | 0.030 | 0.031 | 0.0028 |
| AJ | 0.026 | 0.26 | 0.29 | 0.014 | 0.0011 | 16.5 | 2.5 | 1.9 | 3.5 | 1.42 | 0.19 | 0.13 | 0.041 | 0.060 | 0.0030 |
| AK | 0.027 | 0.23 | 0.27 | 0.014 | 0.0009 | 16.3 | 2.7 | 2.4 | 3.6 | 1.25 | 0.41 | 0.30 | 0.031 | 0.080 | 0.0033 |

| Steel | Composition (mass %) | | | | Formula (1)* | | |
|---|---|---|---|---|---|---|---|
| No. | B | Ti, Zr, Co, Ta | Ca, REM | Mg, Sn, Sb | Value on left-hand side | Agreement | Remarks |
| A | 0.0025 | | | | 2.58 | Agree | PS |
| B | 0.0059 | | | | 2.42 | Agree | PS |
| C | 0.0073 | | | | 3.27 | Agree | PS |
| D | 0.0034 | | | | 2.62 | Agree | PS |
| E | 0.0041 | | | | 3.57 | Agree | PS |
| F | 0.0029 | | | | 3.40 | Agree | PS |
| G | 0.0033 | | | | 4.06 | Agree | PS |
| H | 0.0034 | | | | 3.99 | Agree | PS |
| I | 0.0027 | | | | 1.15 | Agree | PS |
| J | 0.0042 | | | | 3.66 | Agree | PS |
| K | 0.0043 | | | | 3.06 | Agree | PS |
| L | 0.0050 | | | | 1.54 | Agree | PS |
| M | 0.0038 | | | | 4.26 | Agree | PS |
| N | 0.0066 | | | | 1.73 | Agree | PS |
| O | 0.0092 | | | | 3.88 | Agree | PS |
| P | 0.0009 | | | | 1.05 | Agree | PS |
| Q | 0.0071 | Ti: 0.01, Zr: 0.027, Co: 0.08, Ta: 0.025 | Ca: 0.0028, REM: 0.007 | | 1.91 | Agree | PS |
| R | 0.0020 | Ti: 0.01, B: 0.0016, Co: 0.09 | Ca: 0.0028, REM: 0.008 | — | 3.37 | Agree | PS |
| S | 0.0018 | — | — | Mg: 0.0053, Sn: 0.11 | 2.56 | Agree | PS |
| T | 0.0026 | Ti: 0.016 | Ca: 0.0023 | Mg: 0.0061 | 2.91 | Agree | PS |
| U | 0.0044 | Ti: 0.014 | — | — | 1.34 | Agree | PS |
| V | 0.0024 | | | | 2.60 | Agree | CS |
| W | 0.0029 | | | | 2.81 | Agree | CS |
| X | 0.0034 | | | | 2.81 | Agree | CS |
| Y | 0.0031 | | | | 2.69 | Agree | CS |
| Z | 0.0024 | | | | 3.04 | Agree | CS |
| AA | 0.0019 | | | | 5.07 | Agree | CS |
| AB | 0.0026 | | | | 4.01 | Agree | CS |
| AC | 0.0023 | | | | 1.31 | Agree | CS |
| AD | 0.0021 | | | | 1.86 | Agree | CS |
| AE | 0.0025 | | | | 3.04 | Agree | CS |
| AF | 0.0028 | | | | 2.82 | Agree | CS |
| AG | 0.0139 | | | | 2.30 | Agree | CS |
| AH | — | | | | 2.86 | Agree | CS |
| AI | 0.0034 | | | | 0.91 | Disagree | CS |
| AJ | 0.0059 | | | | 2.54 | Agree | PS |
| AK | 0.0041 | Ti: 0.11 | Ca: 0.0035 | Sb: 0.35 | 4.23 | Agree | PS |

Underline means outside the range of the present invention

*$5.1 \times \{(Nb + 0.5Ta) - 10^{-2.2}/(C + 1.2N)\} + Cu \geq 1.0$ . . . (1)

PS: Present Steel

CS: Comparative Steel

TABLE 2

| Steel No. | Steel Pipe No. | Steel pipe material heating temperature (° C.) | Quenching: Heating temperature (° C.) | Quenching: Holding time (min) | Quenching: Cooling stop temperature (° C.) | Tempering: Heating temperature (° C.) | Tempering: Holding time (min) | microstructure (volume %): M (*1) | F (*1) | A (*1) |
|---|---|---|---|---|---|---|---|---|---|---|
| A | 1 | 1180 | 960 | 20 | 30 | 575 | 30 | 61 | 26 | 13 |
| B | 2 | 1180 | 960 | 20 | 30 | 575 | 30 | 55 | 29 | 16 |
| C | 3 | 1180 | 960 | 20 | 30 | 575 | 30 | 55 | 28 | 17 |
| D | 4 | 1180 | 960 | 20 | 30 | 575 | 30 | 54 | 31 | 15 |
| E | 5 | 1150 | 960 | 20 | 30 | 590 | 30 | 63 | 23 | 14 |
| F | 6 | 1150 | 960 | 20 | 30 | 590 | 30 | 51 | 35 | 14 |
| G | 7 | 1150 | 960 | 20 | 30 | 590 | 30 | 63 | 22 | 15 |
| H | 8 | 1150 | 970 | 20 | 30 | 575 | 30 | 62 | 26 | 12 |
| I | 9 | 1150 | 970 | 20 | 30 | 575 | 30 | 59 | 28 | 13 |
| J | 10 | 1180 | 970 | 20 | 30 | 575 | 30 | 60 | 22 | 18 |
| K | 11 | 1180 | 970 | 20 | 30 | 575 | 30 | 64 | 25 | 11 |
| L | 12 | 1180 | 970 | 20 | 30 | 590 | 30 | 59 | 29 | 12 |
| M | 13 | 1180 | 970 | 20 | 30 | 590 | 30 | 52 | 29 | 19 |
| N | 14 | 1180 | 970 | 20 | 30 | 590 | 30 | 54 | 33 | 13 |
| O | 15 | 1180 | 980 | 20 | 30 | 575 | 30 | 59 | 29 | 12 |
| P | 16 | 1150 | 980 | 20 | 30 | 575 | 30 | 62 | 27 | 11 |
| Q | 17 | 1150 | 980 | 20 | 30 | 575 | 30 | 63 | 26 | 11 |
| R | 18 | 1150 | 980 | 20 | 30 | 575 | 30 | 58 | 28 | 14 |
| S | 19 | 1150 | 980 | 20 | 30 | 590 | 30 | 55 | 32 | 13 |
| T | 20 | 1150 | 980 | 20 | 30 | 590 | 30 | 58 | 30 | 12 |
| U | 21 | 1150 | 980 | 20 | 30 | 590 | 30 | 58 | 29 | 13 |
| V | 22 | 1180 | 960 | 20 | 30 | 575 | 30 | 62 | 27 | 11 |
| W | 23 | 1180 | 960 | 20 | 30 | 575 | 30 | 63 | 24 | 13 |
| X | 24 | 1180 | 960 | 20 | 30 | 575 | 30 | 48 | 41 | 11 |
| Y | 25 | 1180 | 960 | 20 | 30 | 590 | 30 | 43 | 30 | 27 |
| Z | 26 | 1150 | 960 | 20 | 30 | 590 | 30 | 63 | 21 | 16 |
| AA | 27 | 1150 | 970 | 20 | 30 | 575 | 30 | 63 | 23 | 14 |
| AB | 28 | 1150 | 970 | 20 | 30 | 575 | 30 | 52 | 29 | 19 |
| AC | 29 | 1150 | 970 | 20 | 30 | 575 | 30 | 61 | 25 | 14 |
| AD | 30 | 1150 | 970 | 20 | 30 | 590 | 30 | 61 | 27 | 12 |
| AE | 31 | 1180 | 970 | 20 | 30 | 590 | 30 | 61 | 24 | 15 |
| AF | 32 | 1180 | 980 | 20 | 30 | 590 | 30 | 57 | 29 | 14 |
| AG | 33 | 1180 | 980 | 20 | 30 | 575 | 30 | 61 | 26 | 13 |
| AH | 34 | 1180 | 980 | 20 | 30 | 575 | 30 | 56 | 30 | 14 |
| AI | 35 | 1180 | 980 | 20 | 30 | 575 | 30 | 53 | 29 | 18 |
| AJ | 36 | 1230 | 970 | 20 | 30 | 575 | 30 | 57 | 27 | 16 |
| AJ | 37 | 1180 | 1170 | 20 | 30 | 575 | 30 | 51 | 38 | 11 |
| AJ | 38 | 1180 | 980 | 20 | 60 | 575 | 30 | 48 | 31 | 21 |
| AJ | 39 | 1180 | 980 | 20 | −25 | 575 | 30 | 63 | 33 | 4 |
| AJ | 40 | 1180 | 980 | 20 | 30 | 700 | 30 | 57 | 30 | 13 |
| AJ | 41 | 1180 | 980 | 20 | 30 | 480 | 30 | 61 | 28 | 11 |
| AK | 42 | 1150 | 970 | 20 | 30 | 575 | 30 | 64 | 24 | 12 |

| Steel No. | Maximum crystal grain diameter of ferrite grains | Yield strength YS (MPa) | Tensile strength TS (MPa) | $vE_{-40}$ (J) | Corrosion rate (mm/y) | Pitting corrosion | SSC | see | Remarks |
|---|---|---|---|---|---|---|---|---|---|
| A | 363 | 921 | 1019 | 51 | 0.033 | Absent | Pass | Pass | PE |
| B | 391 | 909 | 1001 | 53 | 0.035 | Absent | Pass | Pass | PE |
| C | 372 | 913 | 1015 | 52 | 0.035 | Absent | Pass | Pass | PE |
| D | 343 | 915 | 1016 | 46 | 0.029 | Absent | Pass | Pass | PE |
| E | 316 | 891 | 999 | 61 | 0.033 | Absent | Pass | Pass | PE |
| F | 322 | 883 | 991 | 60 | 0.022 | Absent | Pass | Pass | PE |
| G | 307 | 880 | 992 | 69 | 0.059 | Absent | Pass | Pass | PE |
| H | 339 | 913 | 1016 | 56 | 0.027 | Absent | Pass | Pass | PE |
| I | 321 | 918 | 1021 | 54 | 0.038 | Absent | Pass | Pass | PE |
| J | 364 | 911 | 1020 | 49 | 0.030 | Absent | Pass | Pass | PE |
| K | 390 | 923 | 1019 | 53 | 0.035 | Absent | Pass | Pass | PE |
| L | 383 | 885 | 994 | 50 | 0.038 | Absent | Pass | Pass | PE |
| M | 401 | 892 | 996 | 60 | 0.028 | Absent | Pass | Pass | PE |
| N | 385 | 895 | 995 | 55 | 0.047 | Absent | Pass | Pass | PE |
| O | 378 | 913 | 1021 | 46 | 0.040 | Absent | Pass | Pass | PE |
| P | 320 | 915 | 1023 | 53 | 0.039 | Absent | Pass | Pass | PE |
| Q | 299 | 930 | 1027 | 50 | 0.031 | Absent | Pass | Pass | PE |
| R | 316 | 927 | 1009 | 59 | 0.037 | Absent | Pass | Pass | PE |
| S | 308 | 893 | 986 | 65 | 0.033 | Absent | Pass | Pass | PE |
| T | 351 | 888 | 979 | 71 | 0.029 | Absent | Pass | Pass | PE |
| U | 327 | 890 | 983 | 60 | 0.032 | Absent | Pass | Pass | PE |
| V | 383 | 901 | 1015 | 40 | 0.068 | Present | Fail | Fail | CE |
| W | 374 | 905 | 1000 | 43 | 0.056 | Present | Fail | Fail | CE |
| X | 362 | 840 | 1011 | 47 | 0.022 | Absent | Pass | Pass | CE |

TABLE 2-continued

| | | | | | | | | | |
|---|---|---|---|---|---|---|---|---|---|
| Y | 393 | 855 | 1007 | 39 | 0.031 | Absent | Pass | Pass | CE |
| Z | 325 | 900 | 1008 | 25 | 0.024 | Absent | Fail | Fail | CE |
| AA | 360 | 916 | 1011 | 43 | 0.040 | Absent | Fail | Pass | CE |
| AB | 333 | 917 | 1003 | 42 | 0.135 | Present | Fail | Fail | CE |
| AC | 307 | 838 | 959 | 33 | 0.041 | Absent | Fail | Fail | CE |
| AD | 328 | 844 | 954 | 43 | 0.032 | Absent | Pass | Pass | CE |
| AE | 394 | 830 | 944 | 38 | 0.037 | Absent | Pass | Pass | CE |
| AF | 381 | 841 | 950 | 40 | 0.045 | Absent | Fail | Fail | CE |
| AG | 405 | 911 | 1022 | 20 | 0.040 | Absent | Pass | Pass | CE |
| AH | 372 | 920 | 1019 | 50 | 0.027 | Absent | Fail | Pass | CE |
| AI | 355 | 843 | 938 | 61 | 0.038 | Absent | Pass | Pass | CE |
| AJ | 538 | 918 | 1005 | 13 | 0.033 | Absent | Pass | Pass | CE |
| AJ | 522 | 863 | 961 | 25 | 0.037 | Absent | Pass | Pass | CE |
| AJ | 341 | 831 | 937 | 71 | 0.037 | Absent | Pass | Pass | CE |
| AJ | 327 | 1027 | 1105 | 9 | 0.035 | Absent | Pass | Pass | CE |
| AJ | 431 | 843 | 948 | 69 | 0.034 | Absent | Pass | Pass | CE |
| AJ | 317 | 999 | 1100 | 22 | 0.037 | Absent | Pass | Pass | CE |
| AK | 328 | 920 | 1013 | 58 | 0.025 | Absent | Pass | Pass | PE |

Underline means outside the range of the present invention
(*1) M: Tempered martensite phase, F: Ferrite phase, A: Retained austenite phase
PE: Present Example.
CE: Comparative Example The high-strength stainless steel seamless pipes of the present examples all had high strength with a yield strength YS of 862 MPa or more, high toughness with an absorption energy at −40° C. of 40 J or more, and excellent corrosion resistance (carbon dioxide corrosion resistance) in a high-temperature, $CO_2$- and $Cl^-$-containing 200° C. corrosive environment. The high-strength stainless steel seamless pipes of the present examples produced no cracks (SSC, SCC) in the $H_2S$-containing environment, providing high-strength stainless steel seamless pipes for oil country tubular goods having excellent sulfide stress cracking resistance, and excellent sulfide stress corrosion cracking resistance.

On the other hand, in comparative examples outside the range of the present invention, steel pipe No. 22 (steel No. V) had a Ni content of less than 3.0%, and the corrosion resistance was insufficient. Accordingly, pitting corrosion occurred in the corrosion test. This steel pipe was also unacceptable in terms of sulfide stress cracking (SSC) resistance and sulfide corrosion cracking (SCC) resistance.

Steel pipe No. 23 (steel No. W) had a Mo content of less than 2.0%, and pitting corrosion occurred in the corrosion test. This steel pipe was unacceptable in terms of sulfide stress cracking (SSC) resistance and sulfide corrosion cracking (SCC) resistance.

Steel pipe No. 24 (steel No. X) had a Cr content of more than 19.0%. Accordingly, the ferrite fraction was high, and the strength was insufficient.

Steel pipe No. 25 (steel No. Y) had a Ni content of 5.0% or more. Accordingly, the martensite stability was poor, and the strength was insufficient.

Steel pipe No. 26 (steel No. Z) had a Mo content of 2.8% or more. Accordingly, an intermetallic compound precipitated, and the toughness was insufficient. This steel pipe was also unacceptable in terms of sulfide stress cracking (SSC) resistance and sulfide corrosion cracking (SCC) resistance.

Steel pipe No. 27 (steel No. AA) had a Cu content of more than 3.5%. Accordingly, hot workability was insufficient, despite the addition of B. This steel pipe also had defects at the time of rolling, and the sulfide stress corrosion cracking (SSC) resistance was unacceptable.

Steel pipe No. 28 (steel No. AB) had a Cr content of 15.0% or less. Accordingly, the corrosion resistance was insufficient, and the corrosion rate was high in the corrosion test. This steel pipe also had pitting corrosion, and was unacceptable. Steel pipe No. 28 was also unacceptable in terms of sulfide stress cracking (SSC) resistance and sulfide corrosion cracking (SCC) resistance.

Steel pipe No. 29 (steel No. AC) had a Cu content of less than 0.3%, and the strength was insufficient. This steel pipe was also unacceptable in terms of sulfide stress cracking (SSC) resistance and sulfide corrosion cracking (SCC) resistance.

Steel pipe No. 30 (steel No. AD) had a Nb content of less than 0.07%, and the strength was insufficient.

Steel pipe No. 31 (steel No. AE) had a V content of less than 0.01%, and the strength was insufficient.

Steel pipe No. 32 (steel No. AF) had a W content of less than 0.1%. Accordingly, the corrosion resistance was insufficient, and the corrosion rate was high in the corrosion test. This steel pipe also had pitting corrosion, and was unacceptable. Steel pipe No. 32 was also unacceptable in terms of sulfide stress cracking (SSC) resistance and sulfide corrosion cracking (SCC) resistance.

Steel pipe No. 33 (steel No. AG) had a B content of more than 0.0100%, and the low-temperature toughness was insufficient.

Steel pipe No. 34 (steel No. AH) had a B content of less than 0.0005%, and the hot workability was insufficient. This steel pipe also had defects at the time of rolling, and the sulfide stress cracking (SSC) resistance was unacceptable.

In steel pipe No. 35 (steel No. AI), the value of formula (1) was less than 1.0, and the strength was insufficient.

In steel pipe No. 36 (steel No. AJ), the heating temperature of the steel pipe material was higher than 1,200° C. Accordingly, the ferrite crystal grains coarsened, and the low-temperature toughness was insufficient.

In steel pipe No. 37 (steel No. AJ), the quenching temperature of the steel pipe material was higher than 1,150° C. Accordingly, the ferrite crystal grains coarsened, and the low-temperature toughness was insufficient.

In steel pipe No. 38 (steel No. AJ), the cooling stop temperature was higher than 50° C., and the strength was insufficient.

In steel pipe No. 39 (steel No. AJ), the cooling stop temperature was below 0° C., and the low-temperature toughness was insufficient.

In steel pipe No. 40 (steel No. AJ), the tempering temperature of the steel pipe material was higher than 650° C., and the strength was insufficient.

In steel pipe No. 41 (steel No. AJ), the tempering temperature of the steel pipe material was below 500° C., and the low-temperature toughness was insufficient.

The invention claimed is:

1. A method for manufacturing a high-strength stainless steel seamless pipe having a microstructure that is at least 45% tempered martensite phase, 20 to 40% ferrite phase, and more than 10% and 25% or less retained austenite phase by volume, having a yield strength of 862 MPa or more, and a maximum crystal grain diameter of 500 μm or less for ferrite crystal grains when crystal grains with a crystal orientation difference of within 15° are defined as the same crystal grains, and having an absorption energy $vE_{-40}$ of 40 J or more as measured by a Charpy impact test at a test temperature of −40° C., the method comprising:

heating a steel pipe material at a heating temperature of 1,200° C. or less, the steel pipe material having a composition that comprises, in mass %, C: 0.05% or less, Si: 1.0% or less, Mn: 0.1 to 0.5%, P: 0.05% or less, S: less than 0.005%, Cr: more than 15.0% and 19.0% or less, Mo: more than 2.0% and less than 2.8%, Cu: 0.3 to 3.5%, Ni: 3.0% or more and less than 5.0%, W: 0.1 to 3.0%, Nb: 0.07 to 0.5%, V: 0.01 to 0.5%, Al: 0.001 to 0.1%, N: 0.010 to 0.100%, O: 0.01% or less, and B: 0.0005 to 0.0100%, and in which Nb, Ta, C, N, and Cu satisfy the following formula (1), and the balance is Fe and incidental impurities;

hot working the steel pipe material to make a seamless steel pipe of a predetermined shape;

quenching the seamless steel pipe in which the hot-worked seamless steel pipe is reheated in a temperature range of 850 to 1,150° C., and cooled to a cooling stop temperature at a cooling rate of air cooling or faster, the cooling stop temperature being a temperature at which a surface temperature is 50° C. or less and more than 0° C.; and tempering the seamless steel pipe by heating the seamless steel pipe at a tempering temperature of 500 to 650° C.:

$$5.1\times\{(Nb+0.5Ta)-10^{-2.2}/(C+1.2N)\}+Cu\geq 1.0, \quad \text{Formula (1)}$$

where Nb, Ta, C, N, and Cu represent the content of each element in mass %, and the content is 0 (zero) for elements that are not contained.

2. The method for manufacturing a high-strength stainless steel seamless pipe according to claim 1, wherein the composition further comprises, in mass %, one, two, or more selected from Ti: 0.3% or less, Zr: 0.2% or less, Co: 1.0% or less, and Ta: 0.1% or less.

3. The method for manufacturing a high-strength stainless steel seamless pipe according to claim 2, wherein the composition further comprises, in mass %, one or two selected from Ca: 0.0050% or less, and REM: 0.01% or less.

4. The method for manufacturing a high-strength stainless steel seamless pipe according to claim 3, wherein the composition further comprises, in mass %, one, two, or more selected from Mg: 0.01% or less, Sn: 0.2% or less, and Sb: 1.0% or less.

5. The method for manufacturing a high-strength stainless steel seamless pipe according to claim 2, wherein the composition further comprises, in mass %, one, two, or more selected from Mg: 0.01% or less, Sn: 0.2% or less, and Sb: 1.0% or less.

6. The method for manufacturing a high-strength stainless steel seamless pipe according to claim 1, wherein the composition further comprises, in mass %, one or two selected from Ca: 0.0050% or less, and REM: 0.01% or less.

7. The method for manufacturing a high-strength stainless steel seamless pipe according to claim 6, wherein the composition further comprises, in mass %, one, two, or more selected from Mg: 0.01% or less, Sn: 0.2% or less, and Sb: 1.0% or less.

8. The method for manufacturing a high-strength stainless steel seamless pipe according to claim 1, wherein the composition further comprises, in mass %, one, two, or more selected from Mg: 0.01% or less, Sn: 0.2% or less, and Sb: 1.0% or less.

9. The method for manufacturing a high-strength stainless steel seamless pipe according to claim 1, wherein the composition comprises Mo: more than 2.0% and 2.5% or less, Cu: 0.3 to 2.4%, and W: 0.1 to 1.6%.

* * * * *